United States Patent [19]

Hilton

[11] 4,237,684

[45] Dec. 9, 1980

[54] ROPE

[75] Inventor: William J. Hilton, Ashby-de-la-Zouch, England

[73] Assignee: Bonas Brothers Limited, Burton-On-Trent, England

[21] Appl. No.: 9,214

[22] Filed: Feb. 5, 1979

[51] Int. Cl.[3] ..... D02G 3/00; D02G 3/02

[52] U.S. Cl. ..... 57/260; 57/31; 428/364; 428/365

[58] Field of Search ..... 428/259, 258, 257, 365, 428/377, 364, 397, 400; 57/236, 237, 260, 31

[56] References Cited

U.S. PATENT DOCUMENTS

| | | | |
|---|---|---|---|
| 2,867,890 | 1/1959 | Baxter | 57/31 |
| 3,164,948 | 1/1965 | Stratford | 57/31 X |
| 3,371,477 | 3/1968 | Felix | 57/31 |
| 4,016,911 | 4/1977 | Looker | 428/257 X |

*Primary Examiner*—Lorraine T. Kendell

*Attorney, Agent, or Firm*—Alan H. Levine

[57] ABSTRACT

A rope comprising at least two strips of woven fabric, each said strip having wefts projecting from the woven edge thereof and said strips being twisted together so that the woven parts thereof form a core with the projecting wefts extending substantially radially outwardly from the core.

4 Claims, 8 Drawing Figures

96
98
92
94
94
90

ROPE

This invention relates to rope. The invention also relates to a method and apparatus for making rope. More particularly the invention relates to polypropylene rope and to a method and apparatus for making polypropylene rope.

The problem caused by spillage of oil at sea and on other waterways have been well publicised. With current public concern over pollution there is considerable demand that oil "slicks" should be removed before they are deposited on shore. Attempts have been made to deal with such oil slicks mechanically, for example by using booms to contain the slick. Chemical methods have also been employed for example an agent which renders the oil soluble in water or causes the oil to form a compound which precipitates. However, chemical methods usually preclude recovery of the oil. It must be observed that the oil which forms the slick may be quite valuable. No entirely satisfactory method of dealing with oil slicks has yet been proposed.

It is known that polypropylene has the property of preferentially absorbing oil from an oil/water mixture. Polypropylene is thus an ideal material for cleaning-up oil slicks and from which oil can be readily recovered provided it can be produced in a conveniently practical form.

The present invention has been made inter alia from a consideration of the above mentioned points.

According to the present invention there is provided a rope comprising at least two strips of woven fabric, each said strip having wefts projecting from the woven edge thereof and said strips being twisted together so that the woven parts thereof form a core with the projecting wefts extending substantially radially outwardly from the core.

If desired the warp and weft yarns may be of different yarn and the yarns used in the different strips may be different. When the rope is to be used to treat oil slicks it is preferred that the yarn employed by polypropylene.

The number of strips employed to make the rope is generally greater than two, for example 4 or 8.

The invention also provides a method of making a rope as defined above comprising weaving a strip of fabric such that weft threads project from the woven edge thereof, doubling said strip and thereafter twisting the doubled strip to form a woven core having wefts extending substantially radially therefrom.

If desired the rope formed by the aforesaid method can be doubled and given a further twist, preferably in the opposite sense to that of the first mentioned twisting. The doubling and twisting steps can be repeated until the rope has the desired bulk.

The strips may be woven in many different ways. For example the strips may be woven so that the wefts project from only one side of the woven part. When the strips are woven using a weft inserter, the projecting wefts are in the form of weft loops. It is not essential that all weft threads should project from the woven part of the strip although that is preferred. The strips may be woven as a two ply fabric which is subsequently opened out to provide weft threads extending from either side thereof.

The invention also provides apparatus for producing a rope as defined herein comprising a weaving loom, said loom including means for causing at least some weft yarns to project transversely of the warp yarns, and a twisting device for applying twist to doubled woven strip produced by the loom.

In a preferred embodiment of the apparatus the loom comprises a weft inserter adapted to insert weft yarn through a warp shed and carry the weft transversely of the warps to one side thereof. Means is provided for catching the end of the weft loop so formed and holding it while the weft inserter is withdrawn and at least until the weft is locked by the warps upon a shed change.

The twisting device preferably comprises first means for holding one end of the doubled woven strips, second means for holding the other end of the strip, said first means and/or said second means including means for imparting twist to the strip and tensioning means for controlling the tension in the strip while twist is imparted thereto.

Specific embodiment of the invention will now be described by way of example with reference to the accompanying drawings, in which.

Figure 1:
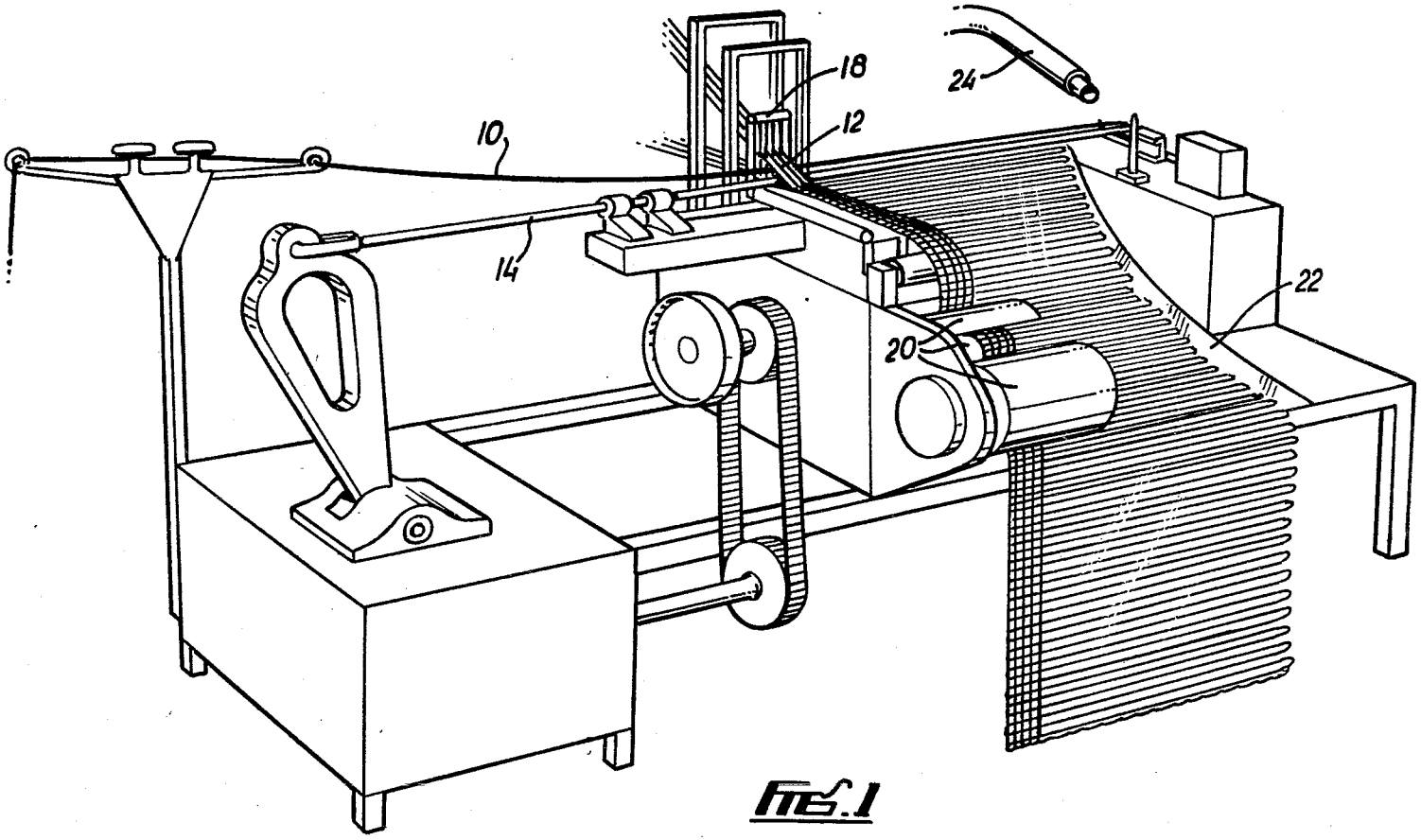
FIG. 1 is a perspective view of a weaving loom.
Figure 2:
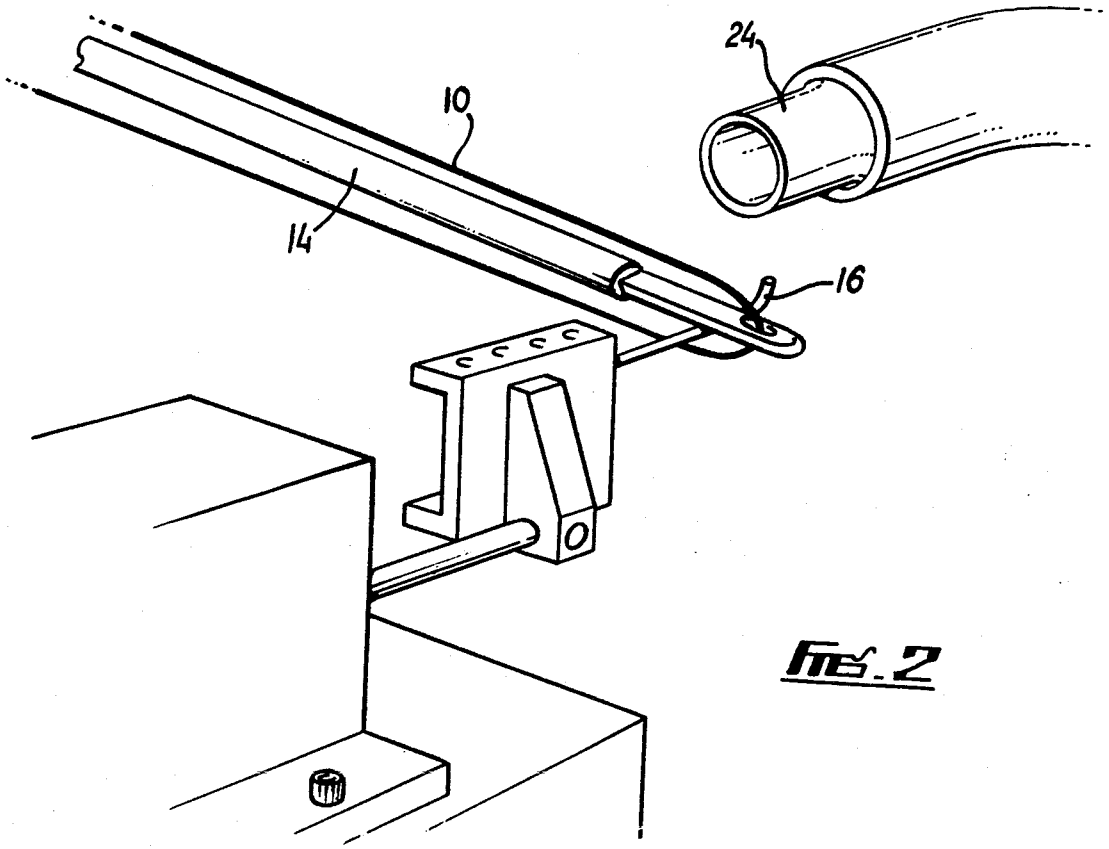
FIG. 2 shows an enlargement of a part of the loom of FIG. 1.
Figure 3:
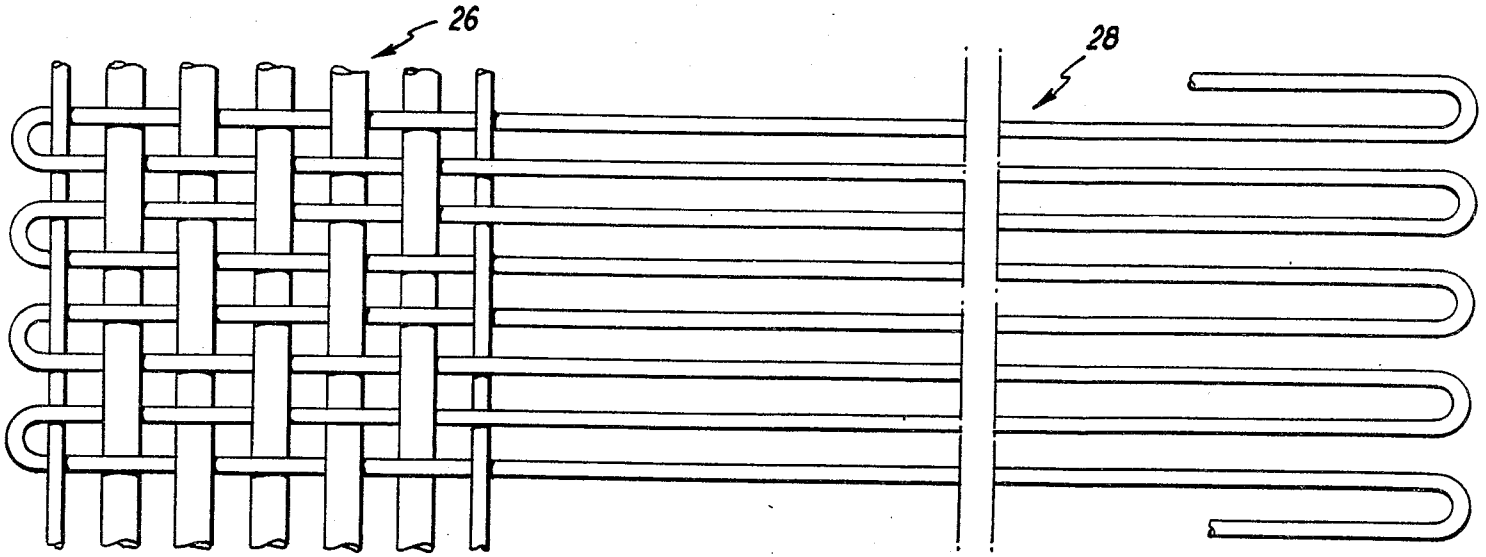
FIG. 3 illustrates fabric produced by the loom of FIG. 1.

Referring to FIGS. 1, 2 and 3 the loom illustrated differs from a conventional narrow fabric loom in that weaving takes place on one side of the loom only thereby creating a plurality of weft threads which extend transversely of the woven fabric. Weft 10 is inserted through a warp shed 12 formed from a relatively small number of warp ends eight for example, by a weft rapier 14. The rapier carries the weft a considerable distance beyond the warp shed to a needle 16 which engages in the end of the weft loop. The rapier 14 is then withdrawn, the weft beaten-up by reed 18, the warp shed changed and a fresh weft loop formed by insertion of the weft rapier.

The woven part of the fabric formed on the loom can be taken down in a conventional manner using take down rollers 20. The weft loops cannot readily be taken down in that way and accordingly are urged down an inclined plane 22 by an air jet from nozzle 24. Other methods of taking down the weft loops can be used. For example the loops may be engaged by the teeth of a timing belt, or they may be led away on an endless conveyor.

The fabric produced by the above described loom is illustrated in FIG. 3 and comprises a relatively narrow woven band 26, for example of 3 inches width, having long weft loops 28 extending from one edge thereof. The weft loops may, for example, extend from 3 to 18 inches from the woven part 26.

The fabric shown in FIG. 3 does not have to be produced by the loom described with reference to FIGS. 1 and 2, but can be made by any suitable apparatus. The fabric may be made from any suitable yarn. When the fabric is intended to be used to absorb oil it is preferred to employ polypropylene yarn, preferably fibrillated polypropylene yarn.

Figure 4:
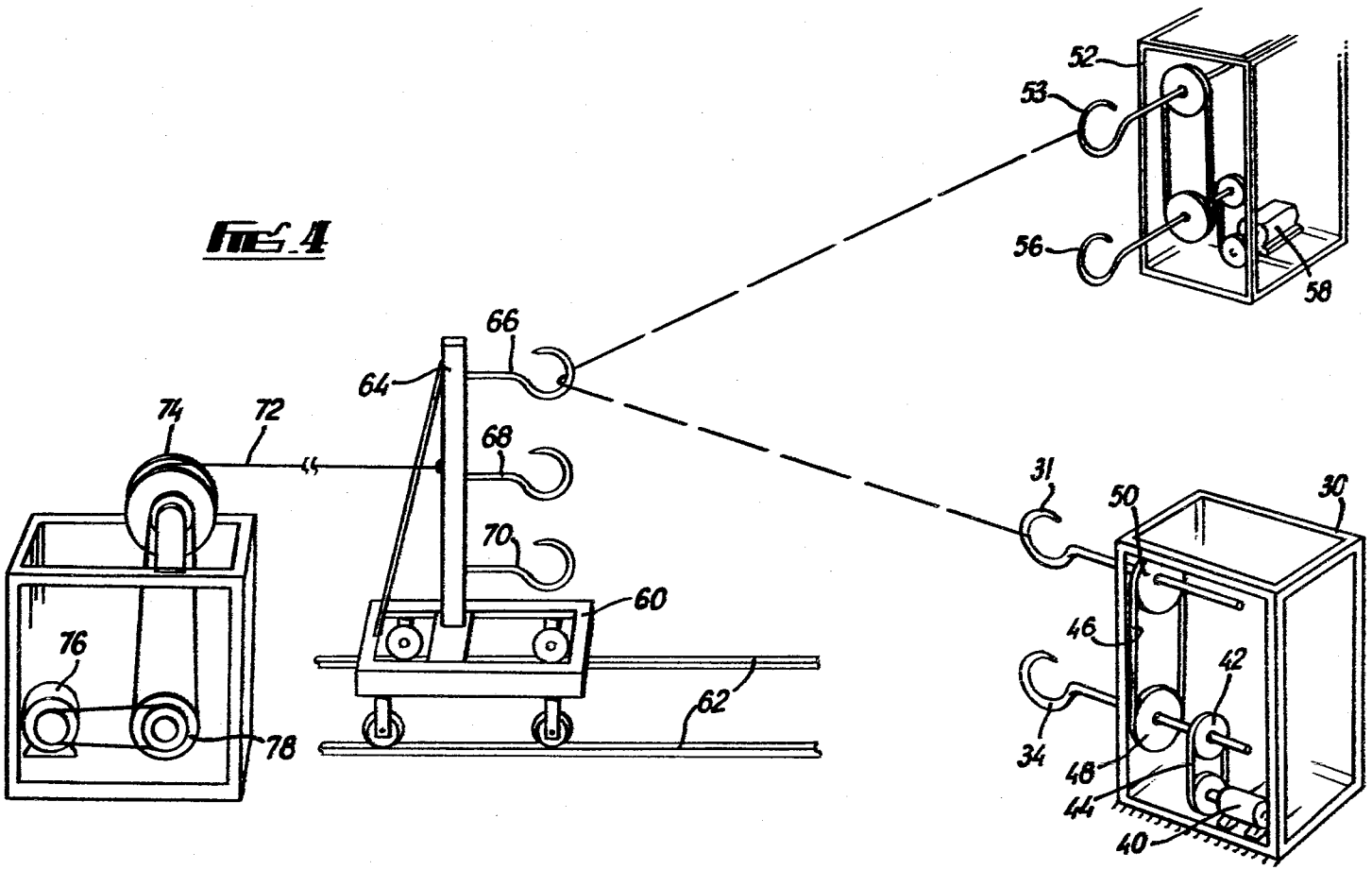
FIG. 4 illustrates diagrammatically, a twisting machine.

The fabric is formed into a rope by doubling and twisting, suitable apparatus for that step being shown diagrammatically in FIG. 4. The apparatus comprises a first fixed frame 30 having two hooks 31 and 34 rotatably mounted therein. Hook 34 is rotated by a motor 40 connected to a pulley 42 on the shank of hook 34 by an endless belt 44. Rotation of hook 34 is transmitted to hook 31 by an endless belt 46 which is mounted on pulleys 48 and 50 on the shanks of hooks 34 and 31 respectively.

A second fixed frame 52 similar to frame 30 is provided. Frame 52 is provided with rotatable hooks 53 and 56 which are rotated by motor 58 in the same way as hooks 31 and 34 by motor 40 in the first frame. The second frame is spaced from the first frame and the two frames are arranged, as can be seen in FIG. 4, with the hooks thereof generally directed towards a trolley 60.

The trolley 60 runs on the rails of a track 62 so as to be movable towards, and away from, the fixed frames 30 and 52. The trolley carries a support 64 in which three vertically spaced apart hooks 66, 68 and 70 are fixed. A wire 72 is attached to the support and is wound on a capstan 74. The capstan 74 is driven by a motor 76 through a gearbox 78 having a torque limit clutch capable of being preset to slip at a predetermined value, for example 55 ft. lb. The capstan, motor and gearbox are mounted on a fixed frame.

Figure 5:
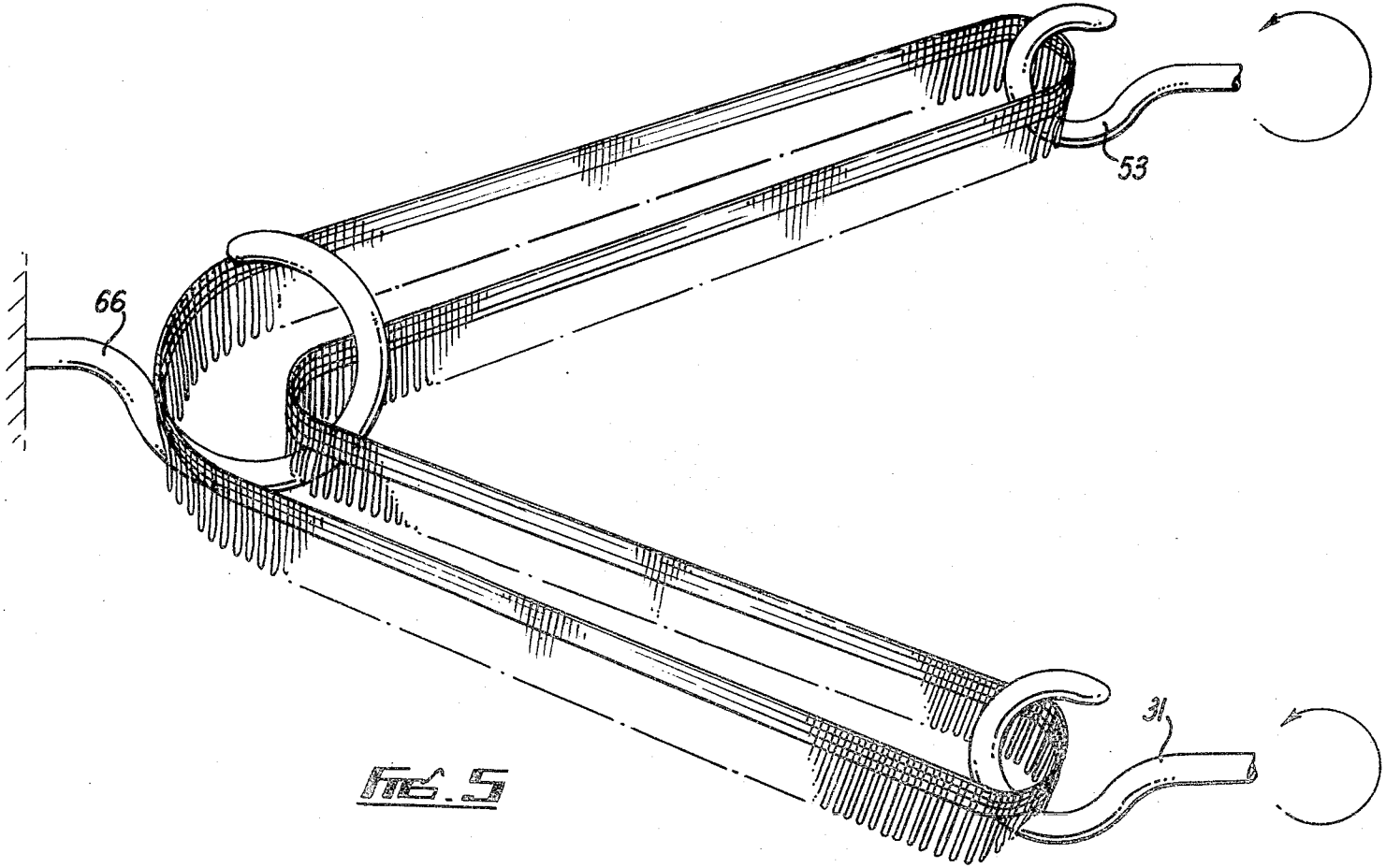
FIG. 5 illustrates the twisting process effected by the twisting machine of FIG. 4.

In order to form a rope using the machine just described, one end of a loop formed from the fabric as described with reference to FIG. 3 is fastened to hook 31 on the first frame. The fabric is then threaded through hook 66 on the trolley and the other end of the loop fastened onto hook 53 on the second frame. At this stage the fabric has the appearance as shown in FIG. 5. A further loop of fabric is similarly disposed on hooks 34, 70 and 56.

The fabrics are tensioned by switching on motor 76 with the result that the trolley 60 is pulled away from frames 30 and 52 until the predetermined torque limit is reached. Motor 76 is then switched-off. Motors 40 and 58 are now started thereby imparting a twist to both loops of the fabric. As the fabric is twisted the overall length thereof is reduced but the tension is maintained at the desired level by virtue of the torque limit clutch.

Figure 6:
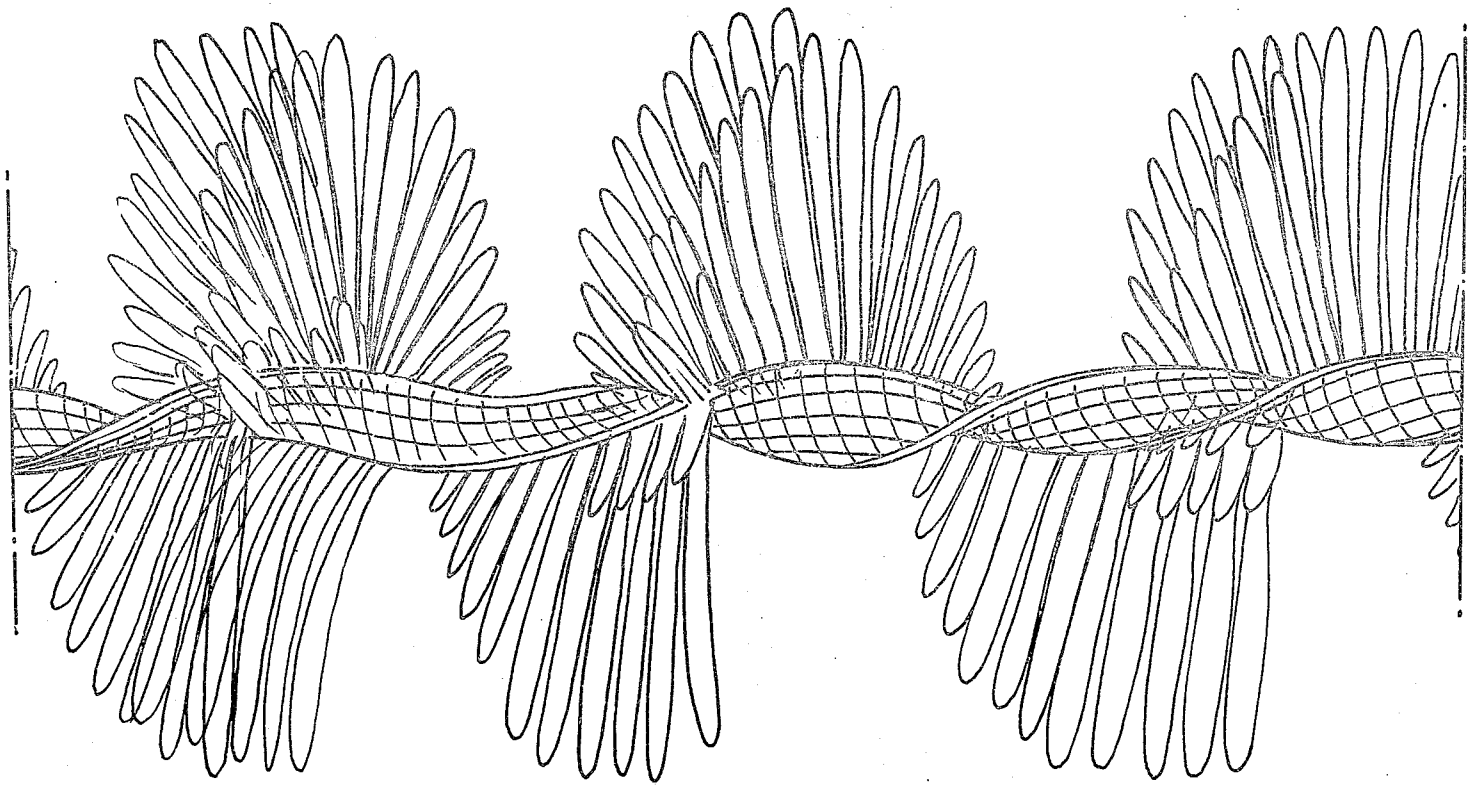
FIG. 6 shows the partly formed rope.

When sufficient twist has been imparted, for example 5 turns per foot length the motors 40 and 58 are stopped. The fabric then has the appearance shown in FIG. 6. The fabric on hook 34 is placed on hook 31 and the other end is transferred from hook 56 to hook 53. Both pieces of fabric are placed over hook 68. Motors 76 is switched on to obtain the required tension in the fabric but on this occasion the motor is kept running. It is important that the speed of the motor 76 is selected so that the torque limit clutch will slip at low speed. This ensures constant tension during the following twisting operation. Motors 40 and 58 are now switched on so as to impart rotation to the hooks 31 and 53 in the opposite sense. The twist now applied to the fabric will also be in the sense opposite to that first imparted and any increase in length of the fabric is taken up by virtue of motor 76. Motors 40 and 58 are stopped when sufficient twist has been given for example 2½ turns per foot length.

Figure 7:
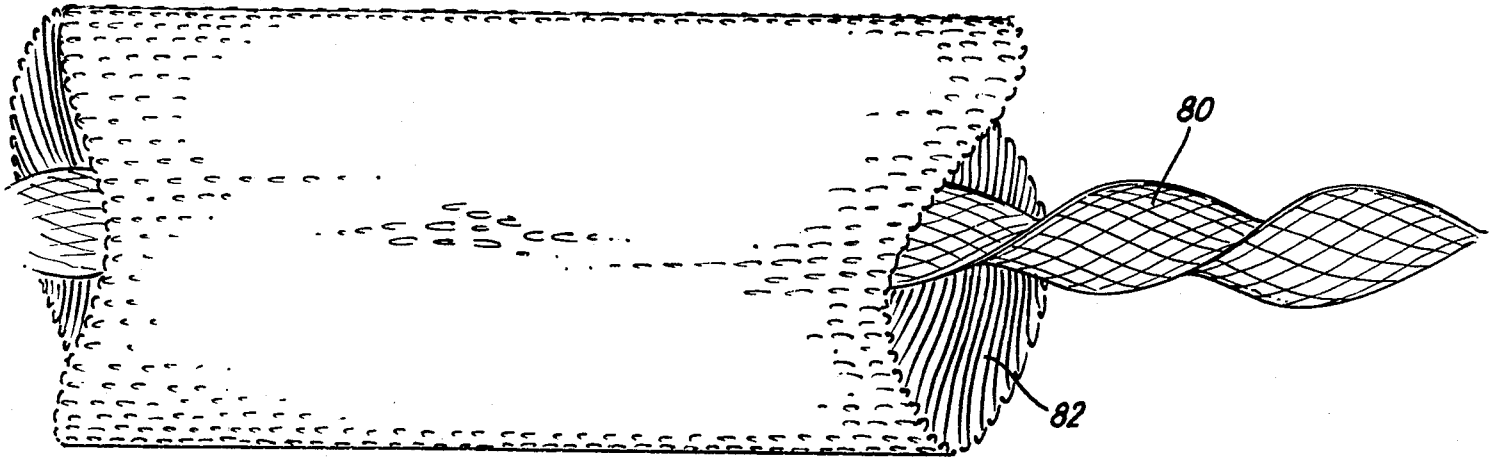
FIG. 7 shows the completed rope with a part removed to show the core.

The product now produced is illustrated in FIG. 7 and is a rope having a central woven core 80 having a multiplicity of radially extending loops 82.

The following Examples further illustrate the invention:

EXAMPLE 1

A fabric such as illustrated in FIG. 3 was woven to the following specifications:

| | | |
|---|---|---|
| Warp: | 12 ends | 3300 denier polypropylene. |
| Weft: | 1 end | 3300 denier polypropylene. |
| Front reed: | 10 gauge. | |
| Picks: | 14 per inch | |

The resultant fabric had a woven part of width 1 inch the weft loops extending 6 inches therefrom. 460 ft of the fabric was threaded over the hooks of the twisting machine with two runs on hooks 31, 66 and 53 and two runs on hooks 34, 70 and 56 and 280 turns of S-twist per 50 ft length applied. The separate runs were combined and 130 turns of Z-twist applied per 50 ft length.

The result was 100 ft length of rope of 12 inches overall diameter having a 4-ply core.

The length of rope produced was formed into an endless loop in the following way. The rope was knotted, for example with a clove hitch, adjacent each end, for example about two feet from each end, to prevent the rope untwisting. The wefts were removed from the free ends to thereby free the warp ends. Each warp end on one end of the rope was joined to a warp end on the other end of the rope by a knot, such as a reef knot, the knot being formed with long tails. When all the warps were joined the clove hitches were untied whereupon the twist in the main part of the rope was transmitted into the knotted part. That twist caused the long tails of the knots to bind together with themselves and with the knotted warp ends to form an extremely strong join.

EXAMPLE 2

A fabric similar to that illustrated in FIG. 3 was woven to the following specifications:

| | | |
|---|---|---|
| Warp: | 18 ends | 3300 denier polypropylene |
| Weft: | 2 ends | 5000 denier polypropylene |
| Front reed: | 6 gauge. | |
| Picks: | 6 per inch. | |

The resultant fabric had a woven part 1½ inches in width, the weft loops extending 16 inches therefrom.

920 ft of the fabric was threaded over the hooks of the twisting machine, there being 4 runs of fabric on hooks 31, 66 and 53 and 4 runs on hooks 34, 70 and 56. 120 turns of S-twist per 50 ft length were applied followed by 40 turns of Z-twist per 50 ft length.

The result was 100 ft length of rope of 30 inches overall diameter having an 8 ply core which was formed into an endless loop in the same way as in Example 1.

Figure 8:
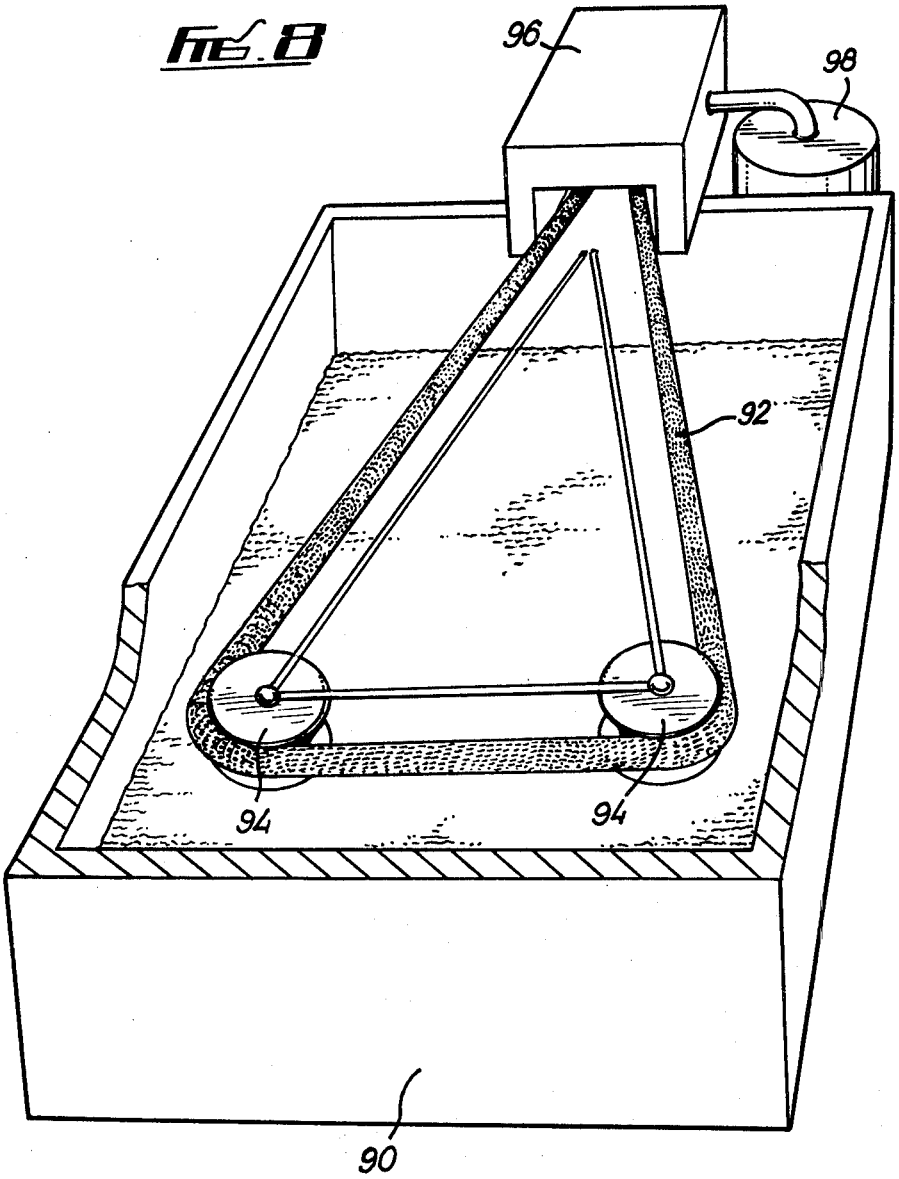
FIG. 8 is a diagrammatic illustration of an oil recovery device.

As has been stated, the rope of the invention, when made of polypropylene is particularly of use in clearing oil-slicks and recovering the oil so cleared. An example of apparatus for that task is shown in FIG. 8. The apparatus comprises a tank 90 for receiving a water/oil mixture and wherein the mixture may separate into its phases.

An endless polypropylene rope 92 in accordance with the invention is disposed to run around pulleys 94 located in the upper (i.e. oil) phase and through squeeze rollers (not shown) located outside the tank as at 96. In use the rope is driven around the pulleys and through the squeeze rollers whereby oil is absorbed by the rope in the settling tank and is then wrung out of the rope by the squeeze rollers. The oil so recovered can be collected in a drum 98.

I claim:

1. A rope comprising a plurality of strips of woven fabric, each said strip having warp and weft yarns and each strip having weft yarns projecting from one woven edge thereof, and said strips being twisted together so that the woven parts thereof form a core with the projecting weft yarns extending substantially radially outwardly from the core.

2. A rope as claimed in claim 1, wherein the warp and weft yarns of each strip are of different materials.

3. A rope as claimed in claim 1, wherein yarns of different materials are used in different strips.

4. A rope as claimed in claim 1, wherein the number of strips in the rope is an even number greater than 2.

* * * * *